US005222309A

United States Patent [19]

Ross

[11] Patent Number: 5,222,309

[45] Date of Patent: Jun. 29, 1993

[54] APPARATUS FOR TRANSFERRING THERMAL ENERGY

[75] Inventor: Henry M. Ross, Nokesville, Va.

[73] Assignee: Ross Industries, Inc., Midland, Va.

[21] Appl. No.: 881,249

[22] Filed: May 11, 1992

[51] Int. Cl.[5] ..... F26B 13/02

[52] U.S. Cl. ..... 34/155; 34/160; 34/223

[58] Field of Search ..... 34/20, 16, 160, 155, 34/223, 225, 230, 233, 210, 212, 205, 203

[56] References Cited

U.S. PATENT DOCUMENTS

| | | | |
|---|---|---|---|
| 4,094,074 | 6/1978 | Schrader et al. | 34/33 |
| 4,094,077 | 6/1978 | Schrader et al. | 34/155 |
| 4,137,649 | 2/1979 | Fleissner | 34/223 |
| 4,219,942 | 9/1980 | Coliva | 34/203 |
| 4,467,537 | 8/1984 | Trotscher | 34/155 |
| 4,523,391 | 6/1985 | Smith et al. | 34/225 |

FOREIGN PATENT DOCUMENTS

| | | | |
|---|---|---|---|
| 1007412 | 8/1963 | United Kingdom | 34/205 |

*Primary Examiner*—Henry A. Bennett
*Assistant Examiner*—Denisel Gromada
*Attorney, Agent, or Firm*—I. J. Crickenberger

[57] ABSTRACT

An apparatus for transferring thermal energy between a temperature-controlled fluid and products to be treated comprises a tunnel having a plurality of openings through which extend duct members for supplying said tunnel with a temperature-controlled fluid from a supply plenum. A perforated metal conveyor belt within said tunnel is driven by a variable speed drive and supports the product to be treated. A return plenum is positioned between the supply plenum and the tunnel and communicates with the tunnel through the plurality of openings. Means to circulate the temperature-controlled fluid forces the fluid through the duct members which collimate the fluid and discharge it in the form of high-velocity jets against the product. The jets break up the boundary layer around the product to facilitate heat transfer and the fluid rebounds through the openings through which the ducts project into a return plenum without producing laminar flow across the treated product.

2 Claims, 3 Drawing Sheets

APPARATUS FOR TRANSFERRING THERMAL ENERGY

BACKGROUND OF THE INVENTION

The prior art contains a number of devices which employ a plurality of nozzles directing fluid jets against the surfaces of various products such as food portions to effect rapid heat transfer, either to heat or to cool the product. These devices work by breaking up the boundary layer surrounding the product, thereby increasing the surface heat transfer coefficient. The efficiency of this process is of particular importance in cooling and freezing applications, because inefficiencies manifest themselves in the form of additional heat.

After the fluid jets impinge against the surface of the product, the fluid should be directed to a return plenum in a way that will not permit it to flow horizontally over the surface, since such action tends to re-establish laminar flow. If horizontal flow is permitted, the cumulative horizontal component of fluid velocity becomes greater as the last jet-forming nozzle is approached prior to exit to the return plenum, since the fluid from all preceding nozzles must exit through the zone of the final nozzles. This large horizontal velocity component impedes the action of the vertically impinging jets in breaking through the boundary layer surrounding the product to be treated, and also tends to re-establish laminar flow conditions with their attendant insulating boundary layer effect.

It is the purpose of the present invention to minimize the effects of the boundary layer problem by providing a multiplicity of return paths for fluid flow to the return plenum which do not allow the fluid to establish horizontal or laminar flow across the paths of the impinging jets.

SUMMARY OF THE INVENTION

The present invention provides a thermal transfer apparatus in which the return paths for the temperature-controlled fluid are coaxial with the supply paths, thereby eliminating all components of horizontal fluid flow over the product to be treated. This result is accomplished by arranging the return plenum between the supply plenum and the cooling tunnel. The collimating tubes which feed the fluid to the cooling tunnel project through openings in the tunnel wall. These openings are sufficiently large in cross-section to permit the returning fluid to establish paths around the outsides of the projecting tubes and exit the tunnel through the openings into the return plenum.

BRIEF DESCRIPTION OF THE DRAWING

The invention will now be described by way of example and with reference to the accompanying drawing in which.

DESCRIPTION OF THE INVENTION

Figure 1:
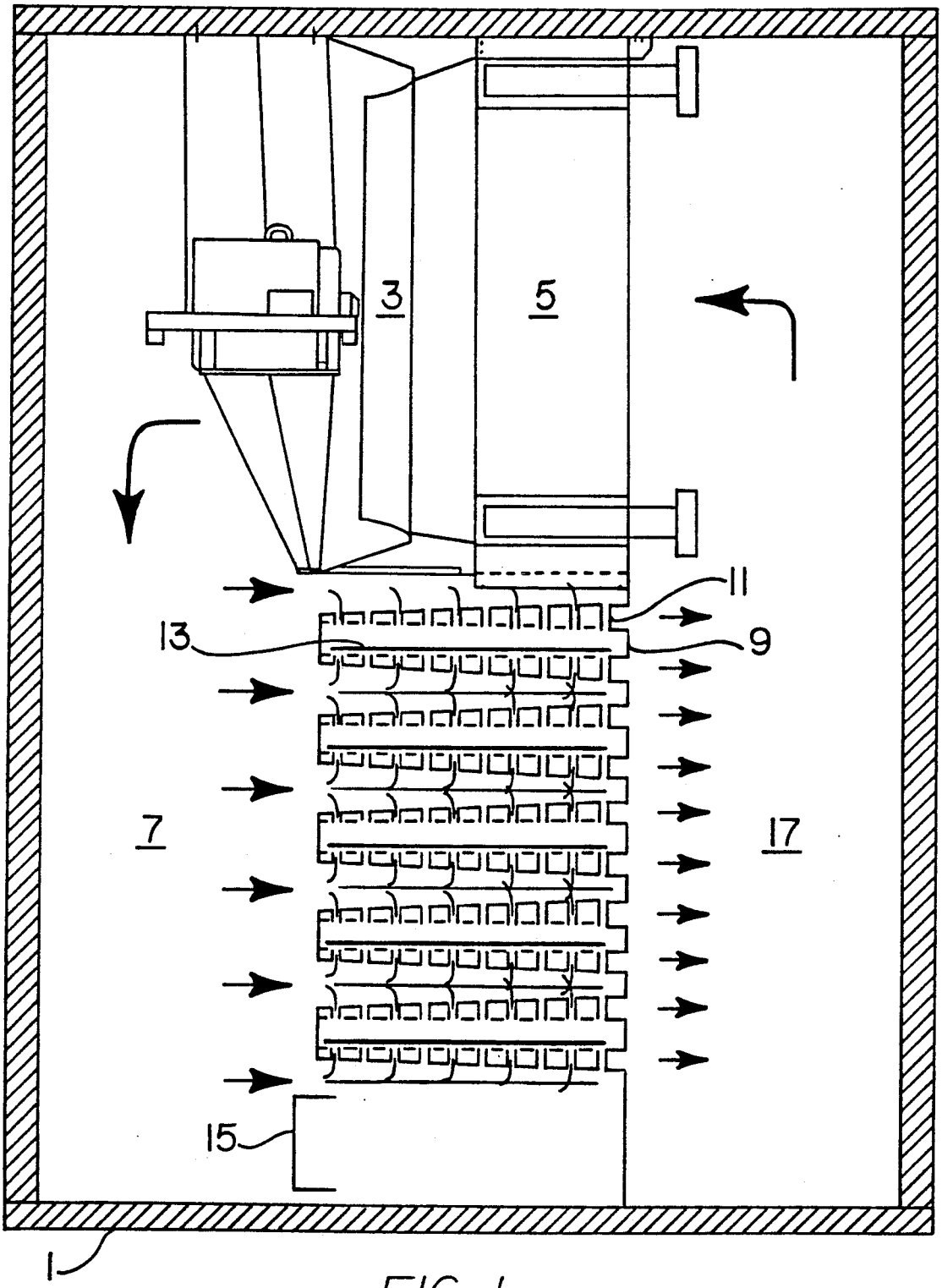
FIG. 1 is a diagrammatic cross-section of an apparatus embodying the principles of the invention.
Figure 2:
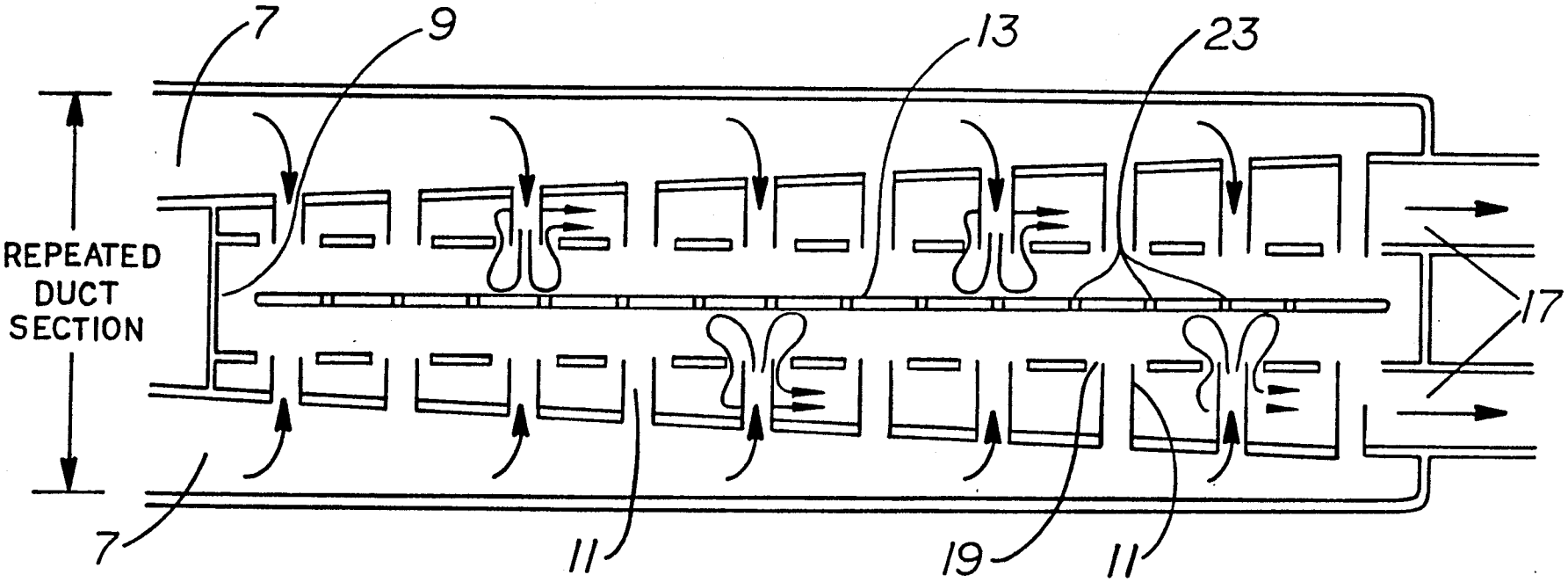
FIG. 2 is an enlarged cross-section of one of the tunnels shown in FIG. 1.

FIGS. 1 and 2 show an apparatus 1 which includes a fan and venturi arrangement 3 as a means for circulating temperature-controlled air throughout the apparatus.

An evaporator 5 is provided to maintain the air at the desired temperature. The cold air from the evaporator 5 is drawn into a supply plenum 7 which provides a source of cooling for the cooling tunnel 9. In FIG. 1, there are five cooling tunnels in stacked array to provide efficiency of operation. For the purposes of description, it is only necessary to consider the operation of one tunnel.

Cold air in the supply plenum 7 is forced through the collimating tubes 11, which terminate in nozzles that direct jets of cold air against a product to be treated which is supported on a perforated metal conveyor belt 13. The conveyor belt 13 is driven by a variable speed drive means 15 which provides a way to control the time of exposure of the product to the impinging jets of cold air.

Portions of the return plenum 17 extend between portions of the supply plenum 7 and the tunnel 9, and tunnel 9 communicates with return plenum 17 through the openings 19 in the walls of the tunnel through which the collimating tubes 11 project.

Figure 3:
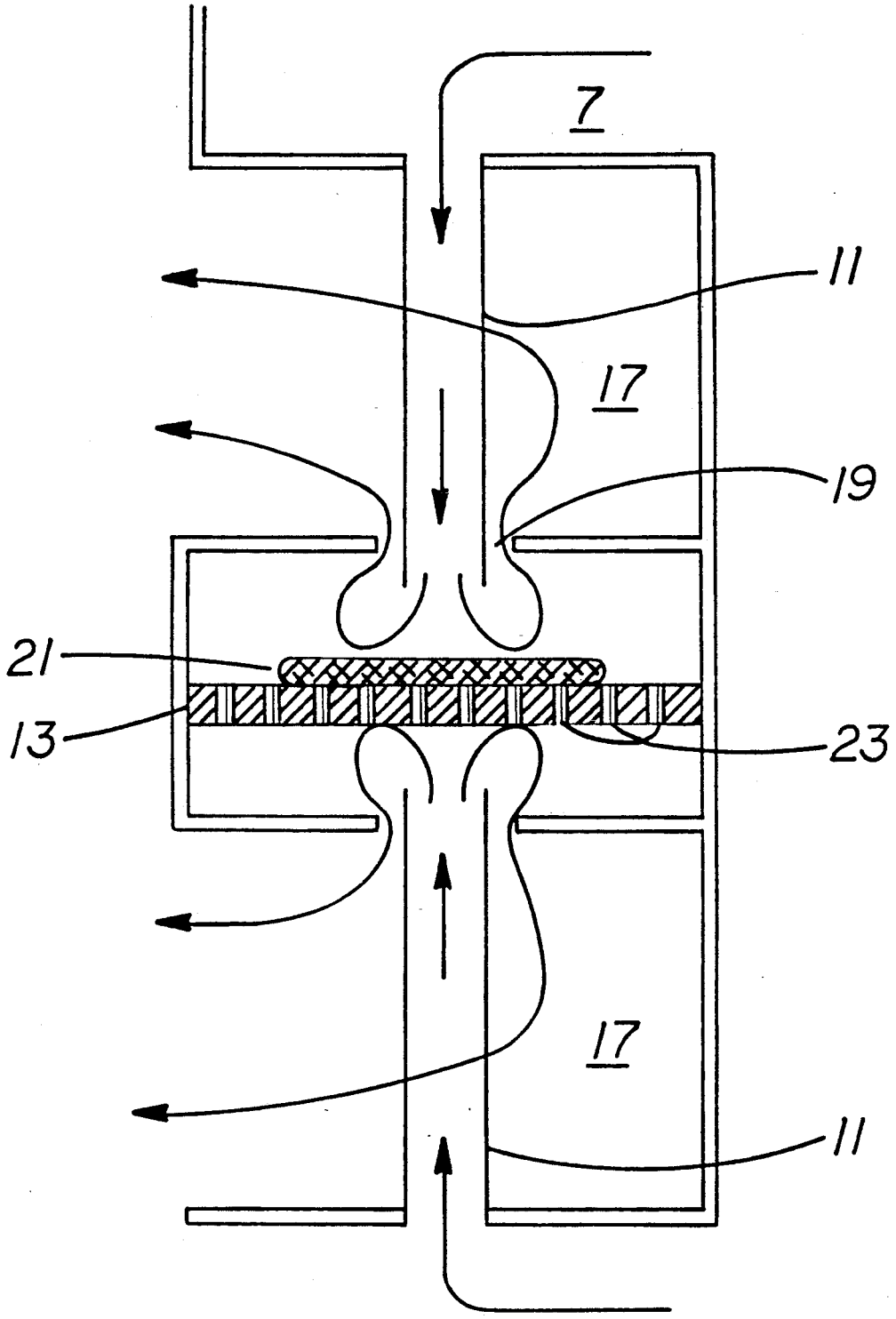
FIG. 3 is a cross-section of a simplified structure utilized to describe the principles of operation of the invention.

FIG. 3 is a simplified illustration that will lend itself to an explanation of operating principle of the invention. The product 21 to be treated is shown being supported on perforated metal conveyor belt 13 in tunnel 9. Cold air from supply plenum 7 is directed downwardly toward the product 21 through the nozzle end of collimating tube 11. As the cold air impinges on the surface of the product 21, it rebounds upwardly through the opening 19 in the upper wall of tunnel 9 and exits into return plenum 17. A similar action takes place on the underside of conveyor belt 13 by virtue of the perforations in the conveyor belt which allow a substantial amount of air to pass through. Also, the conveyor belt is very thin and is made of heat-conductive metal which facilitates the transfer of heat.

The fluid jets which impinge on the product at right angles disrupt the boundary layer and eliminate the horizontal flow of air, thereby increasing the surface heat transfer coefficient. Horizontal flow is not re-established because the exit paths for the fluid are also at right angles to the product. As a matter of convenience the operation of the invention has been described with air as the fluid medium, but it is obvious that the invention is operable with any fluid medium desired for cooling or heating.

What is claimed is:

1. An apparatus for transferring thermal energy between a temperature-controlled fluid and products to be treated comprising a tunnel member having a plurality of openings dimensioned to receive collimating tubes projecting therethrough, said openings being of sufficient size in cross-section to permit the free passage of a temperature-controlled fluid around said tubes and through said openings, a supply plenum for providing streams of temperature-controlled fluid to said tunnel member through said collimating tubes, a plurality of collimating tubes, each tube having one end connected to said supply plenum and the other end projecting into said tunnel member through respective ones of said plurality of openings, said collimating tubes and the openings through which they project being coaxial in structure, support means within said tunnel member for supporting a product to be treated, a return plenum positioned between said supply plenum and said tunnel member and communicating with said tunnel member through said plurality of openings in said tunnel member, and means for circulating said temperature-controlled fluid from said supply plenum through said tunnel member and said return plenum, whereby said collimating tubes direct high-velocity jets of temperature-controlled fluid against the product within said tunnel member in such fashion as to disperse the boundary layer on the surface of the product, thereby significantly increasing the surface heat transfer coefficient, said jets of fluid rebounding from the product and passing through said openings in said tunnel member and into said return plenum, thereby minimizing any tendency to re-establish the boundary layer that was dispersed by impingement of the jets.

2. The apparatus of claim 1 wherein said support means comprises a perforated metal conveyor belt driven by variable speed drive means.

* * * * *